United States Patent [19]

De Felice

[11] 4,231,477

[45] Nov. 4, 1980

[54] BLISTER PACKAGE FOR MEDICAMENTS SAFE FROM CHILDREN

[75] Inventor: Wilfried De Felice, Kelkheim, Fed. Rep. of Germany

[73] Assignee: Hoechst Aktiengesellschaft, Frankfurt am Main, Fed. Rep. of Germany

[21] Appl. No.: 39,896

[22] Filed: May 17, 1979

[30] Foreign Application Priority Data

May 20, 1978 [DE] Fed. Rep. of Germany ..... 2822100

[51] Int. Cl.[3] ..... B65D 83/04; B65D 85/56; B65D 75/70

[52] U.S. Cl. ..... 206/532; 206/603; 206/634

[58] Field of Search ..... 206/531, 532, 484, 603, 206/634

[56] References Cited

U.S. PATENT DOCUMENTS

| | | | |
|---|---|---|---|
| 3,856,144 | 12/1974 | Kelly | 206/531 |
| 3,900,105 | 8/1975 | Wolfelsperger | 206/603 |
| 3,986,640 | 10/1976 | Redmond | 206/603 |

*Primary Examiner*—William T. Dixson, Jr.
*Attorney, Agent, or Firm*—Curtis, Morris & Safford

[57] ABSTRACT

Blister package for medicaments safe from children consisting of a deep drawn plastics film provided with a plurality of recesses and a covering film that cannot be pushed through and is sealed with the plastics film, wherein incisions forming corners are made in the sealing edge.

9 Claims, 3 Drawing Figures

BLISTER PACKAGE FOR MEDICAMENTS SAFE FROM CHILDREN

This invention relates to a blister package for medicaments in various forms, such as tablets, capsules, dragees, suppositories and the like. The package is safe from children and consists of a deep drawn plastics foil provided with recesses and sealed with a covering foil which cannot be pushed through. The sealing edge of the foil has corner-forming incisions.

Blister packages for medicaments which prevent children from removing the medicament are known but such packages cannot yet be produced economically. New machines are necessary for the prior blister packages as they cannot be produced economically on conventional machines.

DE-OS No. 2,552,812, for example, describes a child safe package for medicaments which has, instead of the four round corners, edges in the form of saw teeth which are used to cut the covering film so that the medicament can be taken out by excerting pressure on the recess. To produce the saw tooth edges, appropriate punching devices are required which are subject to considerable wear on the conventional high speed deep drawing machines. Therefore, the disadvantage exists that the saw teeth formed may be dull and that the opening of the blisters will be difficult, especially for old patients. Moreover, the saw teeth may cause considerable problems on high speed packing machines since transport, stacking and boxing of the blister packages may be difficult. Finally, the sharp saw teeth may present a danger to the patient.

It is, therefore, the object of the present invention to overcome these disadvantages.

The present invention provides a blister package for medicaments safe from children consisting of a deep-drawn plastics film with a plurality of recesses and a covering film heat-sealed therewith, which covering film cannot be pushed through, wherein the sealing edge is provided with corner-forming incisions. The incisions in the sealing edge are preferably formed by rectangular cuts, but they may have any other form of cutting lines. Prior to use, the cut in the edge is bent upward. Then there are one or several sharp points with which to cut the covering film.

In general, a rectangular blister package will be provided with four sharp cutting points having the shape of a corner of a rectangle or any other suitable shape, which points are adapted to be bent upward. It is possible, especially when the blister package has another geometrical shape, to cut in the sealing edge more or less than four cutting points or corners.

The blister package according to the invention will now be described in further detail and by way of example with reference to the accompanying drawing in which FIG. 1 is a plan view of a blister package according to the invention;

Figure 1:
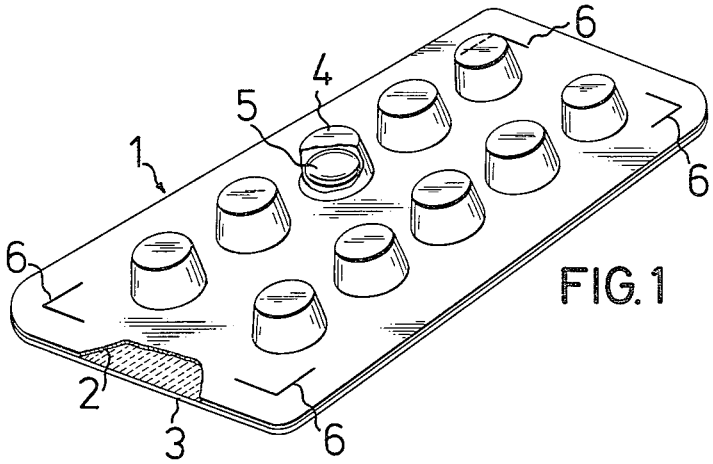

The blister package (1) shown in FIG. 1 is safe from misuse by children and can be produced on a conventional deep drawing machine. In the machine, the hot plastics film (2) is deep drawn by vacuum or pressure, whereby recesses (4) are formed. The medicaments, for example, tablets, capsules, dragees, suppositories and the like (5), are placed in the recesses and a covering film (3), which cannot ruptured by pushing the through medicament the covering film, is sealed under pressure with the deep drawn plastics film (2) by means of heated rolls or plates. Subsequently, the incisions or incision patterns (6) are cut in the sealing edge and at the same time the whole blister package provided with the incisions is punched out.

Figure 2:
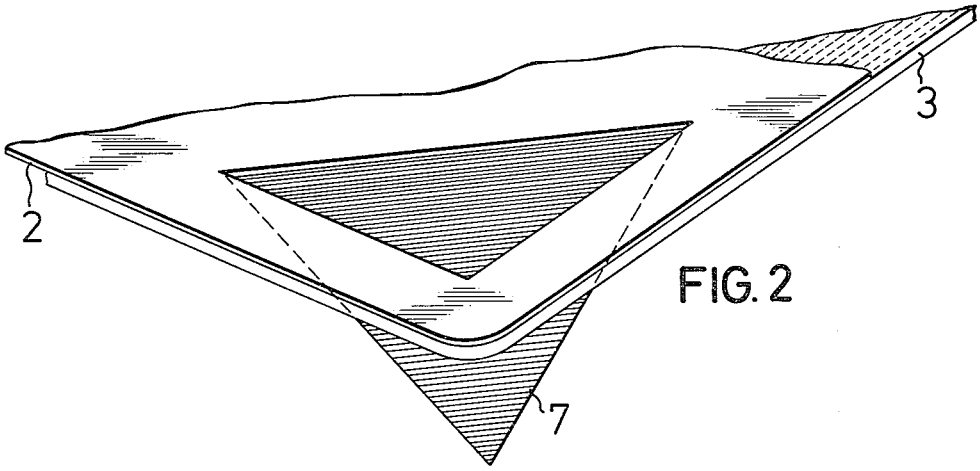
FIG. 2 shows the incised sharp edge on an enlarged scale.
Figure 3:
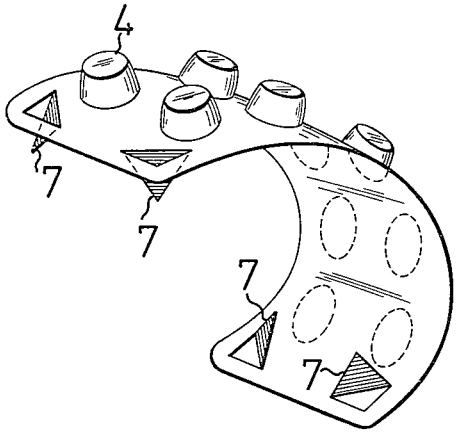
FIG. 3 shows the package with bent up edges or corners.

Since the covering film (3) is impenetrable or cannot be punctured by pressing the medicament through the covering film, to remove the medicament from the blister package, the patient bends upward the edge (7) formed by the incisions as shown in FIGS. 2 and 3 and pushes the sharp cutting point of rectangular upwardly bent edge (7) into the film covering a recess that is easy to reach, as shown in FIG. 3. The medicament can then be removed from the recess by simply pushing or pressing the medicament through the cut in the covering film (3) made by edge (7).

It has been found that the blister package according to the invention is especially useful by providing rectangular shaped incisions. Due to the fact that the incisions are flush with the sealing edge before they are blent upward, the production of the package on conventional high speed machines does not present any difficulty. The medicament in the blister is protected against an uncontrolled removal by a child. It is also possible, of course, to use the package according to the invention for other solid or liquid substances in such cases where child safe packages are desired.

What is claimed is:

1. A blister package for a medicament consisting of a deep drawn plastics film having a sealing edge and being provided with a plurality of recesses for said medicament; a covering film through which said medicament within said recesses cannot be pushed, said covering film being sealed with the plastics film; said sealing edge being provided with an incision forming a cutting corner in the sealing edge for cutting the covering film.

2. The blister package as claimed in claim 1, wherein the corner cut in the sealing edge is made with a rectangular shaped incision.

3. The package as claimed in claim 1, wherein the corner cut in the sealing edge is bendable in an upward direction and provided with a sharp point for incising the covering film.

4. The blister package as claimed in claim 1, having a corner with a sharp point formed by a rectangular incision in the sealing edge, said corner being bendable in an upward direction away from said plastics film.

5. A blister package for medicaments comprising a deep drawn plastics film having an outer perimeter which defines a sealing edge and being provided with a plurality of recess means for receiving the medicament; covering film means sealed to said plastics film for covering the recess means, said covering film means being impenetrable to the medicament, within said recess means, being pushed therethrough; said sealing edge including an incision pattern means formed thereon for forming a cutting edge, when said incision pattern means is bent out of the plane of said sealing edge, to puncture said covering means and release the medicament from said recess.

6. The blister package, as claimed in claim 5, wherein said outer perimeter is substantially rectangular in shape having four corners and is provided with an incision pattern means at each of the four corners.

7. The blister package, as claimed in claim 6, wherein said incision pattern means is cut in the shape of the corner of a rectangle.

8. The blister package, as claimed in claim 5 or 6, wherein the cutting edge of said incision pattern means is provided with a cutting point.

9. The blister package, as claimed in claim 8, wherein said incision pattern means is provided with more than one cutting point.

* * * * *